US006629786B1

(12) United States Patent
Rangarajan et al.

(10) Patent No.: US 6,629,786 B1
(45) Date of Patent: Oct. 7, 2003

(54) ACTIVE CONTROL OF DEVELOPER TIME AND TEMPERATURE

(75) Inventors: Bharath Rangarajan, Santa Clara, CA (US); Michael K. Templeton, Atherton, CA (US); Bhanwar Singh, Morgan Hill, CA (US); Ramkumar Subramanian, Sunnyvale, CA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 09/845,232

(22) Filed: Apr. 30, 2001

(51) Int. Cl.[7] ..... G03D 5/00
(52) U.S. Cl. ..... 396/604; 396/611; 356/345
(58) Field of Search ..... 396/575, 604, 396/611; 118/52, 101, 319–321; 219/121.4; 430/311, 322; 356/436, 345; 264/325

(56) References Cited

U.S. PATENT DOCUMENTS

| | | | | | |
|---|---|---|---|---|---|
| 4,490,319 | A | * | 12/1984 | Lee et al. | 264/325 |
| 5,427,878 | A | * | 6/1995 | Corliss | 356/436 |
| 5,474,877 | A | * | 12/1995 | Suzuki | 430/322 |
| 6,031,211 | A | * | 2/2000 | Mailho et al. | 219/121.4 |
| 6,034,771 | A | * | 3/2000 | Rangarajan et al. | 356/450 |
| 6,196,734 | B1 | * | 3/2001 | Templeton et al. | 396/571 |
| 6,282,457 | B1 | * | 8/2001 | Miura et al. | 700/121 |
| 6,322,626 | B1 | * | 11/2001 | Shirley | 118/52 |

OTHER PUBLICATIONS

Niu, Xinhui, et al *Specular Spectroscopic Scatterometry in DUV Lithography* pp. 1–10.

Smith, Taber H., et al. *Process Control in the Semiconductor Industry*. Http://www–mtl.mit.edu/–taber/Research/Process Control/IERC99/. pp. 1–24. Last viewed on Sep. 26, 2000.

Cote, D.R., et al. *Plasma–assisted Chemical Vapor Deposition of Dielectric Thin Films for UISI Semiconductor Circuits*. Journal of Research and Development. Http://www.research.ibm.com/journal/rd/431/cote.html. pp. 1–30. Last viewed on Sep. 26, 2000.

* cited by examiner

*Primary Examiner*—Della Rutledge
(74) *Attorney, Agent, or Firm*—Amin & Turocy, LLP

(57) ABSTRACT

A system for regulating the time and temperature of a development process is provided. The system includes one or more light sources, each light source directing light to one or more gratings being developed on a wafer. Light reflected from the gratings is collected by a measuring system, which processes the collected light. Light passing through the gratings may similarly be collected by the measuring system, which processes the collected light. The collected light is indicative of the progress of development of the respective portions of the wafer. The measuring system provides progress of development related data to a processor that determines the progress of development of the respective portions of the wafer. The system also includes a plurality of heating devices, each heating device corresponds to a respective portion of the developer and provides for the heating thereof. The processor selectively controls the heating devices so as to regulate temperature of the respective portions of the wafer.

16 Claims, 14 Drawing Sheets

ACTIVE CONTROL OF DEVELOPER TIME AND TEMPERATURE

TECHNICAL FIELD

The present invention generally relates to semiconductor processing, and in particular to a system for regulating post exposure development time and temperature.

BACKGROUND

In the semiconductor industry, there is a continuing trend toward higher device densities. To achieve these high densities there have been, and continue to be, efforts toward scaling down device dimensions (e.g., at sub-micron levels) on semiconductor wafers. In order to accomplish such high device packing densities, smaller and smaller features sizes are required. This may include the width and spacing of interconnecting lines, spacing and diameter of contact holes, and the surface geometry such as corners and edges of various features. Creating features with such reduced device dimensions can require fine control of developing processes, including controlling time and temperature of post exposure developing.

The process of manufacturing semiconductors, or integrated circuits (commonly called ICs, or chips), typically consists of more than a hundred steps, during which hundreds of copies of an integrated circuit may be formed on a single wafer. Generally, the process involves creating several patterned layers on and into the substrate that ultimately forms the complete integrated circuit. This layering process creates electrically active regions in and on the semiconductor wafer surface. Controlling the size, shape and/or location of such electrically active regions can depend on the time over which and the temperature at which a wafer is heated during development after being exposed to a pattern. Thus, sophisticated manufacturing techniques including high-resolution photolithographic processes, including control of development time and temperatures, are required, to achieve desired critical dimensions and yields.

A masking step is employed to protect one area of the wafer while working on another. This process is referred to as photolithography or photo-masking. A photo resist or light-sensitive film is applied to the wafer, giving it characteristics similar to a piece of photographic paper. A photo aligner aligns the wafer to a mask and then projects an intense light through the mask and through a series of reducing lenses, exposing the photo resist with the mask pattern. But exposing the pattern is not all that is involved in developing the pattern. Post exposure development processes can produce differing results based on the time over which and the temperature at which a wafer with a pattern exposed thereon is processed.

Due to the extremely fine patterns that are exposed on the photo resist, controlling the development temperature and the time period over which one or more temperatures are applied during development are significant factors in achieving desired critical dimensions. Maintaining the developer at a desired temperature for a desired period of time may enable uniformity and quality of the underlying photo resist layer being developed. Small changes in the time and temperature history of the developer can substantially alter image sizes, resulting in lack of image line control. For example, a few degrees temperature difference and/or an overly long or short developing time may drastically affect critical dimensions. For example, often substantial line size deviations occur when the developer temperature is not maintained within 0.5 degree tolerance across a silicon wafer or when a wafer is developed for too long a period of time.

Time and temperature are related in the development process. For example, higher temperatures within a range may cause faster development, while lower temperatures may cause slower development. Ideally, all portions of a wafer would develop at precisely the same rate when subjected to identical temperatures for identical times. Unfortunately, such uniform development does not always occur, with different wafer portions developing at different rates. For example, the center of a wafer may develop at a different rate than the edge of a wafer.

The apparatus employed to expose patterns on a wafer may produce variations including, but not limited to, exposure duration, focus and dosage. Thus, the patterns exposed on a wafer may vary, based on such exposure variations. Conventional systems may not account for such variations, basing time and temperature for post exposure development on pre-calculated formulae.

SUMMARY OF THE INVENTION

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

The present invention provides a system that facilitates controlling development temperature and the time over which development temperatures are applied. The present invention can base such control on in situ scatterometry based data acquisition and control information feedback, which provides benefits over conventional systems. An exemplary monitoring system may employ one or more light sources arranged to project light onto one or more patterns exposed on a wafer and/or one or more gratings exposed on the wafer, and one or more light sensing devices (e.g., photo detector, photodiode) for detecting light reflected by and/or allowed to pass through the one or more patterns and/or gratings. The light reflected from and/or passing through one or more patterns and/or gratings is indicative of at least one parameter of the development process (e.g., percent completion of development) that may vary in correlation with developing time and temperature. Such collected light can be employed to generate one or more signatures that can be employed to generate feedback information to control the time and temperature.

In the present invention, one or more heaters are arranged to correspond to particular wafer portions, to facilitate controlling the heat applied to the respective wafer portions. Each heater may be responsible for heating one or more particular wafer portions. The heaters are selectively driven by the system to produce a desired temperature at a wafer portion for a desired time. The heaters may be, for example, heaters and/or coils. The development progress is monitored by the system by comparing the size and/or shape of the patterns and/or gratings on the wafer to desired size and/or shapes. As a result, more optimal development is achieved by controlling the temperatures applied to the portions of the wafer, which in turn increases fidelity of image transfer. Conventional systems may employ pre-determined times and/or temperatures for post exposure developing processes, and thus may not acquire in situ data that can be analyzed to adapt the post exposure developing process. Thus, the present invention, by acquiring such in situ data, and by generating feedback information to adapt the post exposure developing process based on such in situ data provide benefits over conventional systems.

One particular aspect of the invention relates to a system for regulating development time and temperature. At least one heater operates to heat a portion of a wafer, and a heater driving system drives the at least one heater. A system for directing light directs light to one or more patterns and/or gratings being developed on the wafer, and a measuring system measures parameters of the one or more patterns and/or gratings based on light reflected and/or passed through the patterns and/or gratings. A processor is operatively coupled to the measuring system and a heater driving system. The processor receives pattern and/or grating parameter data from the measuring system and the processor uses the data to at least partially base control of the at least one heater so as to regulate temperature of the at least one portion of the wafer being developed.

Another aspect of the present invention relates to a method for regulating development temperature. The method includes defining a wafer as a plurality of portions, developing one or more patterns and/or gratings on a wafer, directing light onto at least one of the patterns and/or gratings and collecting light reflected by and/or passed through the at least one grating. The collected light is analyzed to determine the progress of development of the wafer, with such analysis producing feedback data that is employed in controlling a heating device to regulate the development time and/or temperature.

Still another aspect of the present invention relates to a method for regulating development time and temperature. The method includes partitioning a wafer into a plurality of grid blocks, developing one or more patterns and/or gratings on a wafer and employing one or more heaters to heat the wafer, with each heater functionally corresponding to a respective grid block. The method includes determining the progress of the development of portions of the wafer, where each portion corresponds to a grid block and using a processor to coordinate control of the heaters in accordance with determined and desired temperatures of the respective portions of the wafer.

To the accomplishment of the foregoing and related ends, the invention, then, comprises the features hereinafter fully described and particularly pointed out in the claims. The following description and the annexed drawings set forth in detail certain illustrative examples of the invention. These examples are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1:
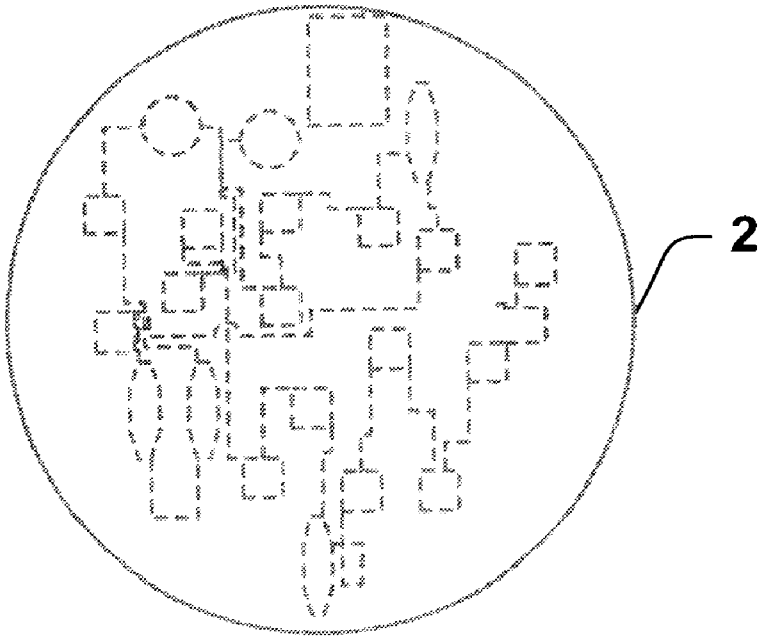
FIG. 1 is a top view of a wafer exposed with a pattern at two different points in time in the post exposure development process.
Figure 1:
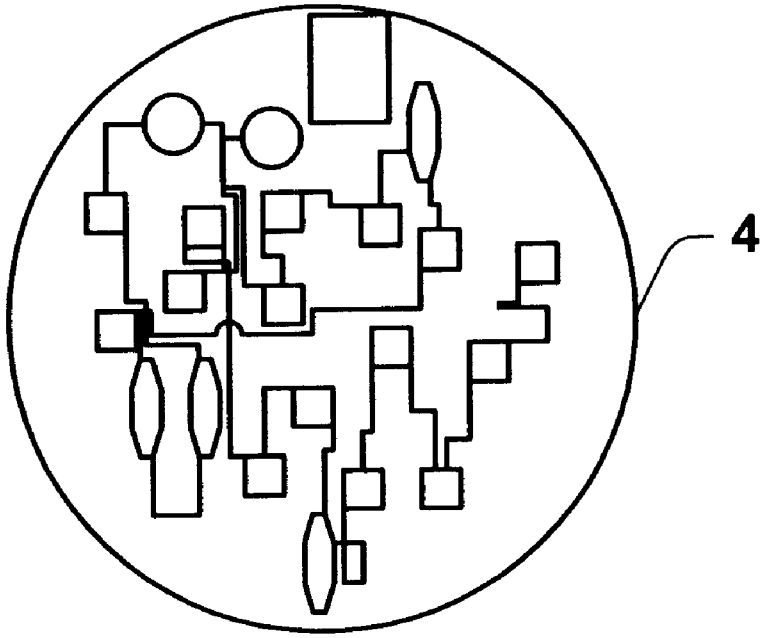

The present invention is now described with reference to the drawings, wherein like reference numerals are used to refer to like elements throughout. In the following description, for purposes of explanation, numerous specific details are set forth in order to provide a thorough understanding of the present invention. It may be evident, however, to one skilled in the art that the present invention may be practiced without these specific details. In other instances, well-known structures and devices are shown in block diagram form in order to facilitate description of the present invention.

As used in this application, the term "component" is intended to refer to a computer-related entity, either hardware, a combination of hardware and software, software, or software in execution. For example, a component may be, but is not limited to, a process running on a processor, a processor, an object, an executable, a thread of execution, a program, and a computer. By way of illustration, both an application running on a server and the server can be a component.

It is to be appreciated that various aspects of the present invention may employ technologies associated with facilitating unconstrained optimization and/or minimization of error costs. Thus, non-linear training systems/methodologies (e.g., back propagation, Bayesian, fuzzy sets, non-linear regression, or other neural networking paradigms including mixture of experts, cerebella model arithmetic computer (CMACS), radial basis functions, directed search networks and function link networks) may be employed.

Referring initially to FIG. 1, a wafer 2 and a wafer 4 are illustrated. The wafer 2 represents a wafer that has a pattern exposed thereon, and which has been exposed to a first post exposure development process, while the wafer 4 represents a wafer that has a pattern exposed thereon, and which has been exposed to a second post exposure development process. By way of illustration, the first exposure process may have involved heating the wafer 2 at a first rate, to a first desired temperature, for a first period of time, while the second exposure process may have involved heating the wafer 4 at a second rate, to a second desired temperature, for a second period of time. Additionally, the wafer 4 may represent the wafer 2, at a later point in time in the first development process. For example, the wafer 4 may have been heated at the first rate, to the first desired temperature, but may have remained at that first desired temperature for a longer period of time. The difference in the brightness, sharpness, color and shape of the lines on the pattern exposed on the wafer 2 and the wafer 4 represent, in an illustrative manner, the effect of time and temperature on the post exposure development process.

The present invention facilitates examining patterns and/or gratings exposed on a wafer, and thus, facilitates acquiring data that can be employed to evaluate parameters associated with the progress of the post exposure development process (e.g., line size, shape, sharpness, color). By way of illustration, the present invention may be employed in situ in examining and evaluating the pattern and/or gratings on the wafer 2, and in generating feedback information that can be employed to control the development process. For example, after examining and evaluating the pattern and/or gratings on the wafer 2, the present invention may generate feedback information to increase the temperature at which the wafer 2 is being developed, and may also generate feedback information to shorten the period of time for which the wafer 2 should be developed. By way of further illustration, the present invention may be employed in situ in examining and evaluating the pattern and/or gratings on the wafer 4 (which may be the wafer 2 at a later point in time), and in generating feedback information that can be employed to control the development process. For example, after examining and evaluating the pattern and/or gratings on the wafer 4, the present invention may generate feedback information to conclude the development process. Thus, by facilitating in situ measurement and analysis, and by facilitating generating feedback information that can be employed in controlling post exposure development processes, the present invention provides advantages over conventional systems.

Figure 2:
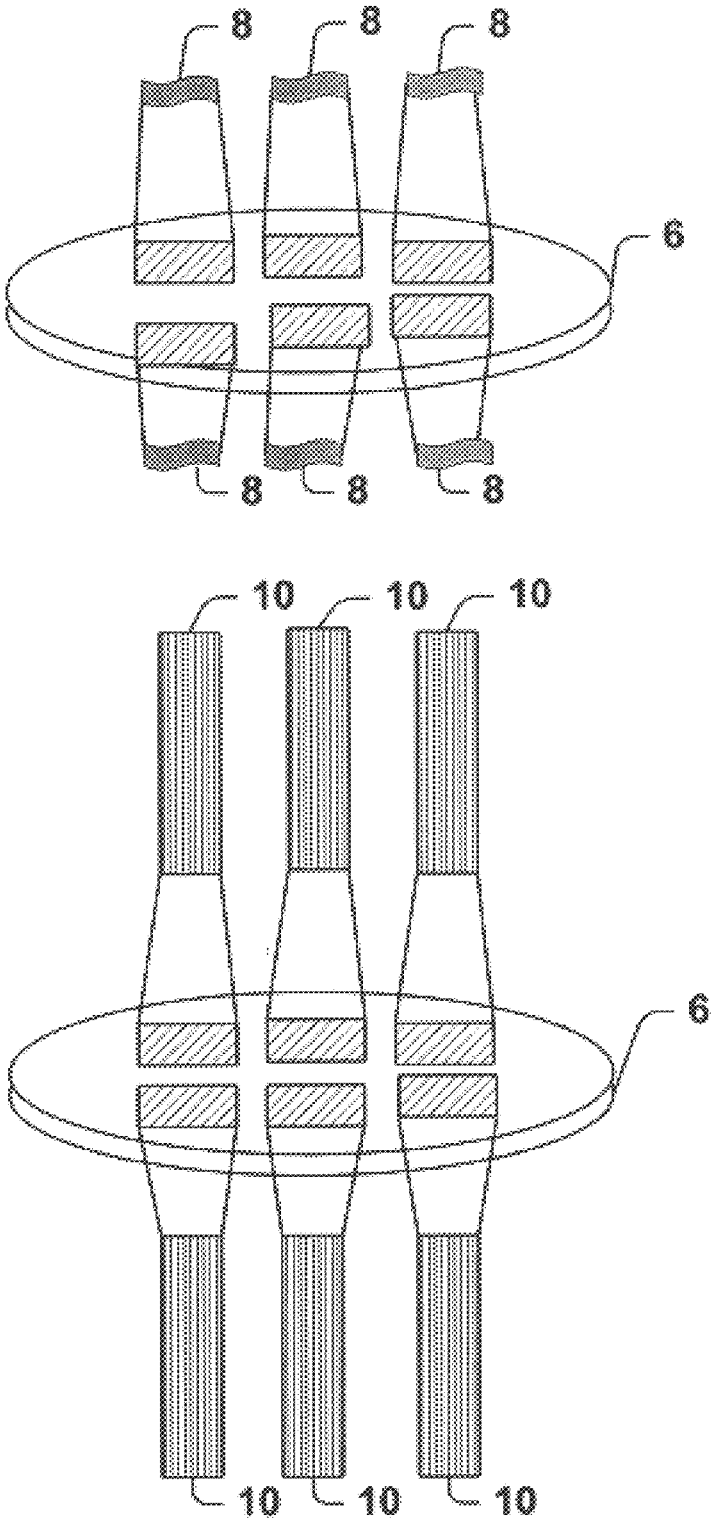
FIG. 2 is a schematic block diagram illustrating a wafer being heated by different types of heater, in accordance with an aspect of the present invention.

Turning now to FIG. 2, a wafer 6 is illustrated being heated by two different methods. While two heating methods are illustrated in FIG. 2, it is to be appreciated that any suitable controllable heating methods and/or apparatus may be employed in accordance with the present invention. In one illustration of the wafer 6 being heated, a plurality of heating coils 8 are illustrated arranged above and below the wafer 6, with each heating coil 8 producing heat that is transmitted to a localized portion of the wafer 6. It is to be appreciated that while six heating coils 8 are illustrated, that a greater or lesser number of heating coils 8 may be employed in accordance with the present invention. Similarly, while heating coils 8 are illustrated above and below the wafer 6, it is to be appreciated that the coils 8 may be located at any suitable location in relation to the wafer 6, in accordance with the present invention.

In another illustration of the wafer 6 being heated, a plurality of heating lamps 10 are illustrated arranged above and below the wafer 6, with each heating lamp 10 producing heat that is transmitted to a localized portion of the wafer 6. It is to be appreciated that while six heating lamps 10 are illustrated, that a greater or lesser number of heating lamps 10 may be employed in accordance with the present invention. Similarly, while heating lamps 10 are illustrated above and below the wafer 6, it is to be appreciated that the lamps 10 may be located at any suitable location in relation to the wafer 6, in accordance with the present invention.

The present invention facilitates generating feedback information that can be employed to control heaters (e.g., heating coils 8, heating lamps 10), to facilitate more precise control of post exposure development processes. By way of illustration, feedback information may be generated that indicates that a first heater should increase the amount of heat it is producing, while a second and third heater should maintain the amount of heat being produced, while a fourth and fifth heater should reduce the amount of heat being produced. Such control facilitates producing more uniformly developed wafers, which can in turn increase chip yield and quality.

Figure 3:
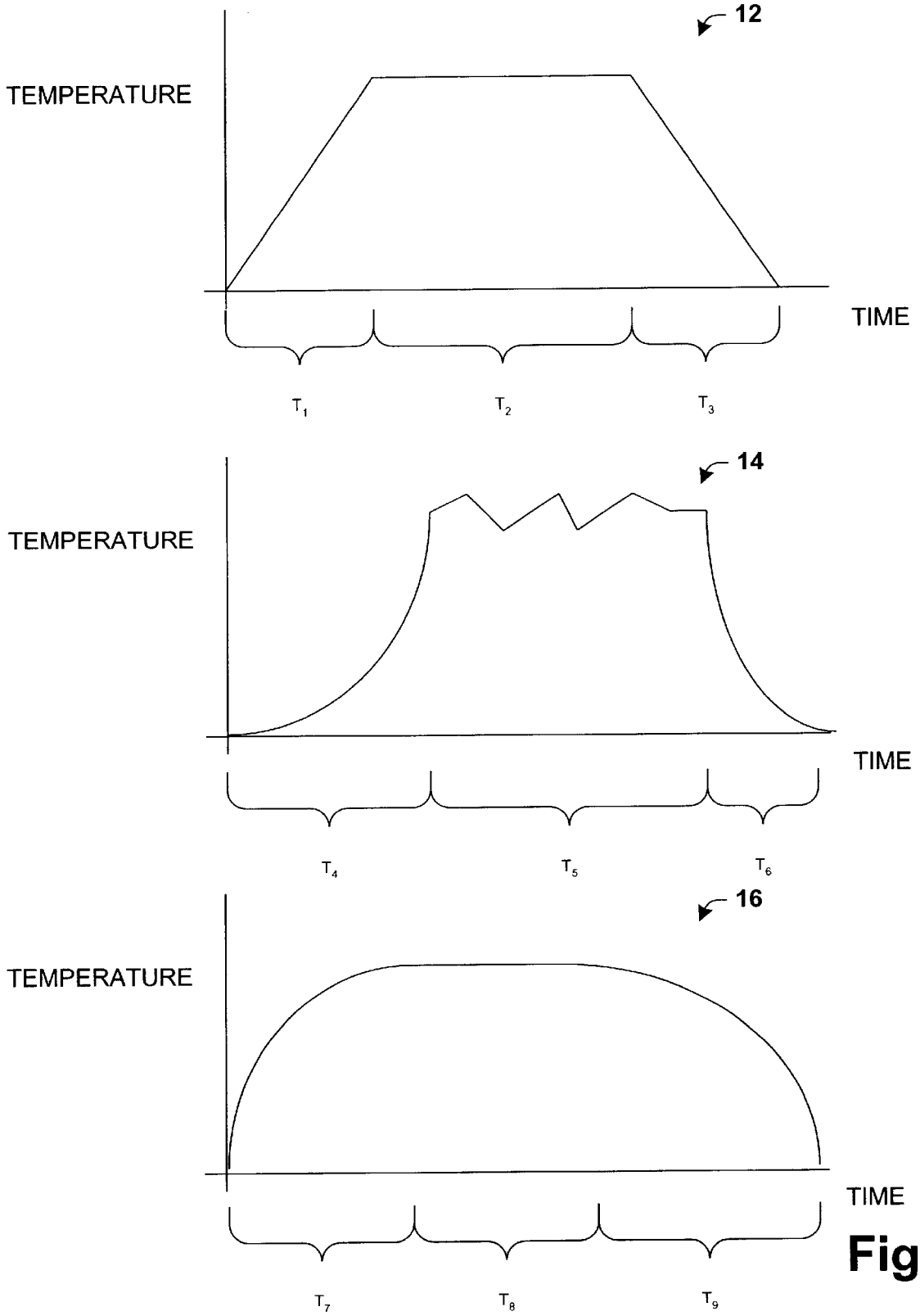
FIG. 3 is a series of graphs illustrating different time and temperature curves that may be encountered in a post exposure development process.

Referring Now to FIG. 3, three graphs relating time and temperature in a post exposure development process are illustrated. The first graph 12 plots a linear increase in temperature over a period of time $T_1$, followed by a constant temperature over a period of time $T_2$, followed by a linear decrease over a period of time $T_3$. Conventionally, such a relationship between time and temperature may be calculated to produce desired post exposure development results. However, such conventional pre-calculations may not account for processing changes due to situations including, but not limited to, wafer to wafer variations, variations within a wafer, exposer dosage variations and exposer time variations, for example. The present invention facilitates examining and evaluating developing patterns and/or gratings on a wafer and thus facilitates generating feedback information that can be employed to recalculate, in situ, the length of times $T_1$, $T_2$ and/or $T_3$, and the temperature that is to be applied during those periods of time. Graph 12 presents a very smooth relationship between time and temperature. But in some apparatus, perhaps due to instantaneous or localized conditions, temperature may not be controllable in such a manner to produce such a smooth relationship.

Thus, graph 14 presents a time and temperature plot where the increase of temperature occurs over a time $T_4$, followed by a temperature that varies about a median temperature during period $T_5$ and a temperature decrease over period $T_6$. Temperature changes like those illustrated during time $T_5$ may occur due to localized instantaneous events (e.g., power brownout, power surge, apparatus malfunction) or simply because a post exposure development apparatus has difficulty maintaining a constant desired temperature. Given that a desired temperature may not be precisely maintainable, variations in post exposure developing processes may occur. The present invention, by monitoring in situ the results of post exposure developing, facilitates accounting for such variations by producing feedback information that may be employed to control the times $T_4$, $T_5$, and $T_6$, and the temperatures of one or more heaters employed to achieve and/or maintain desired temperatures during such time periods. Thus, rather than relying on pre-calculated equations, or indirect measurements (e.g., atmosphere during post exposure process), the present invention relies on direct, in situ measurements to produce a more optimal post exposure development process.

Graph 16 presents yet another time/temperature plot. It is to be appreciated that the time/temperature plots of graphs 12, 14 and 16 are merely representative, employed to illustrate that relationships between time and temperature exist in post exposure development processes, and that in situ control of time and temperature can produce improvements over conventional pre calculated control information and/or indirect measurements.

Figure 4:
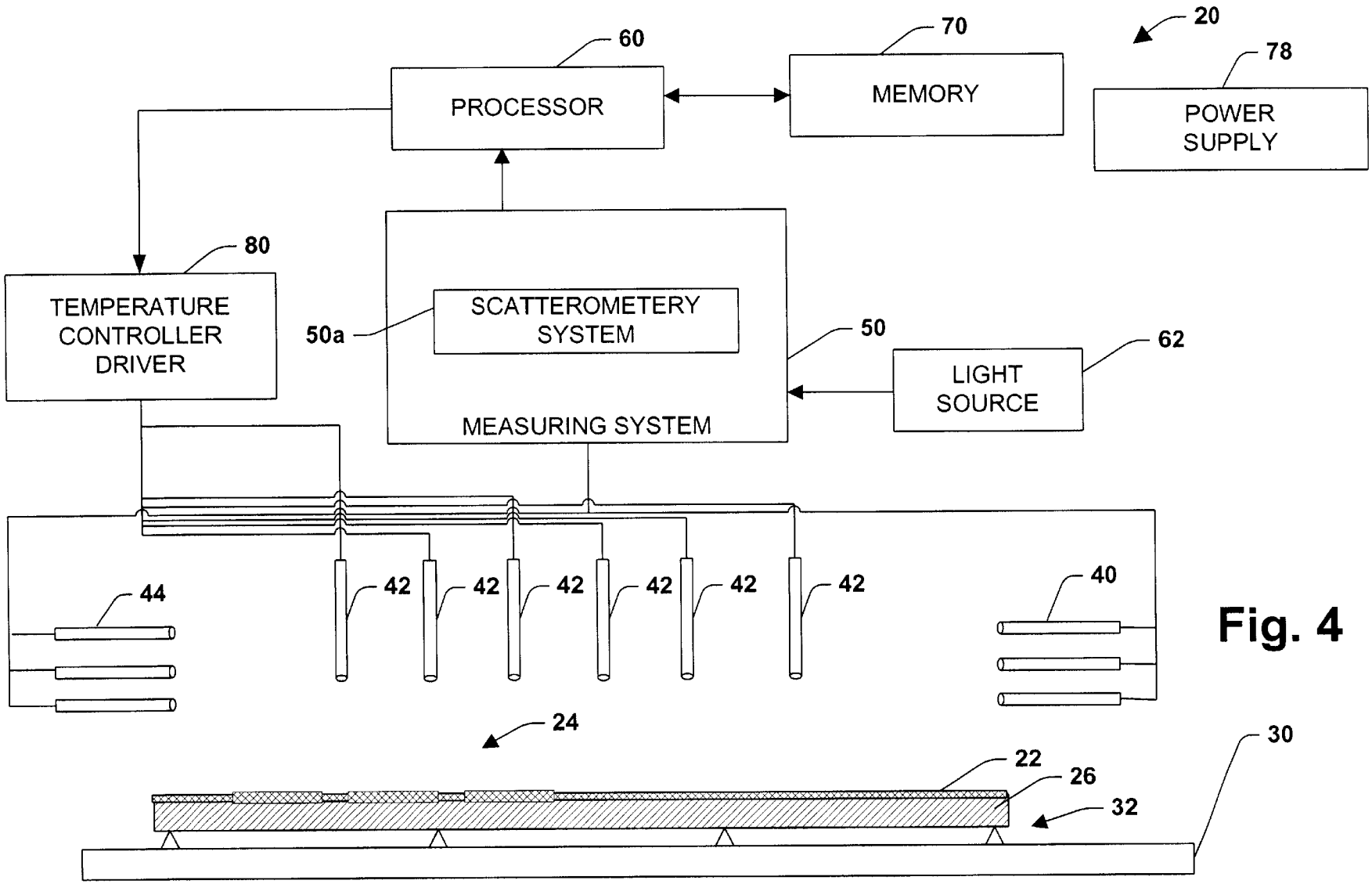
FIG. 4 is a schematic block diagram of a development temperature monitoring and controlling system in accordance with the present invention.

Referring now to FIG. 4, a system 20 for controlling development temperature of a wafer 22 is shown. One or more gratings 24 and/or patterns may be developed on the wafer 22. The system 20 includes one or more heaters 42 that are selectively controlled by the system 20 so as to facilitate controlled heating of the wafer 22. One or more light sources 44 project light onto respective portions of the wafer 22. A portion may have one or more gratings 24 being developed on that portion. Light reflected and/or passed through the one or more gratings 24 is collected by one or more light detecting components 40 and processed by a grating parameter measuring system 50 to measure at least one parameter relating to the development of the one or more gratings 24. The reflected and/or passed through light is processed with respect to the incident light in measuring the various parameters. While the discussion of scatterometry signature generation is primarily undertaken in the context of the one or more gratings 24, it is to be appreciated that other patterns may also be employed in accordance with the present invention.

The measuring system 50 includes a scatterometry system 50*a*. It is to be appreciated that any suitable scatterometry system may be employed to carry out the present invention and such systems are intended to fall within the scope of the appended claims.

A source of light 62 (e.g., a laser) provides light to the one or more light sources 44 via the measuring system 50. Preferably, the light source 62 is a frequency stabilized laser however it will be appreciated that any laser or other light source (e.g., laser diode or helium neon (HeNe) gas laser) suitable for carrying out the present invention can be employed. One or more light detecting components 40 (e.g., photo detector, photo diodes) collect light reflected from or passed through the one or more gratings 24.

A processor 60 receives the measured data from the measuring system 50 and determines the progress of development of the respective portions of the wafer 22. The processor 60 is operatively coupled to the measuring system 50 and is programmed to control and operate the various components within the temperature controlling system 20 in order to carry out the various functions described herein. The processor, or CPU 60, may be any of a plurality of processors, such as the AMD K7 and other similar and compatible processors. The manner in which the processor 60 can be programmed to carry out the functions relating to the present invention will be readily apparent to those having ordinary skill in the art based on the description provided herein.

A memory 70, which is operatively coupled to the processor 60, is also included in the system 20 and serves to store program code executed by the processor 60 for carrying out operating functions of the system 20 as described herein. The memory 70 also serves as a storage medium for temporarily storing information such as developer temperature, temperature tables, developer coordinate tables, grating sizes, grating shapes, scatterometry information, and other data that may be employed in carrying out the present invention.

A power supply 78 provides operating power to the system 20. Any suitable power supply (e.g., battery, line power) may be employed to carry out the present invention. The processor 60 is also coupled to a heater driving system 80 that drives the heaters 42. The heater driving system 80 is controlled by the processor 60 to selectively vary heat output of the respective heaters 42. Each respective portion of the wafer 22 is associated with a corresponding heater 42. The heaters 42 can be apparatus including, but not limited to, lamps and coils. The processor 60 monitors the development of the one or more gratings 24 and selectively regulates the temperatures of each portion via corresponding heaters 42. As a result, the system 20 provides for more precisely regulating the temperature of the wafer 22, which in turn improves fidelity of image transfer in a lithographic process and produces higher IC yield and quality as compared to conventional systems.

Figure 5:
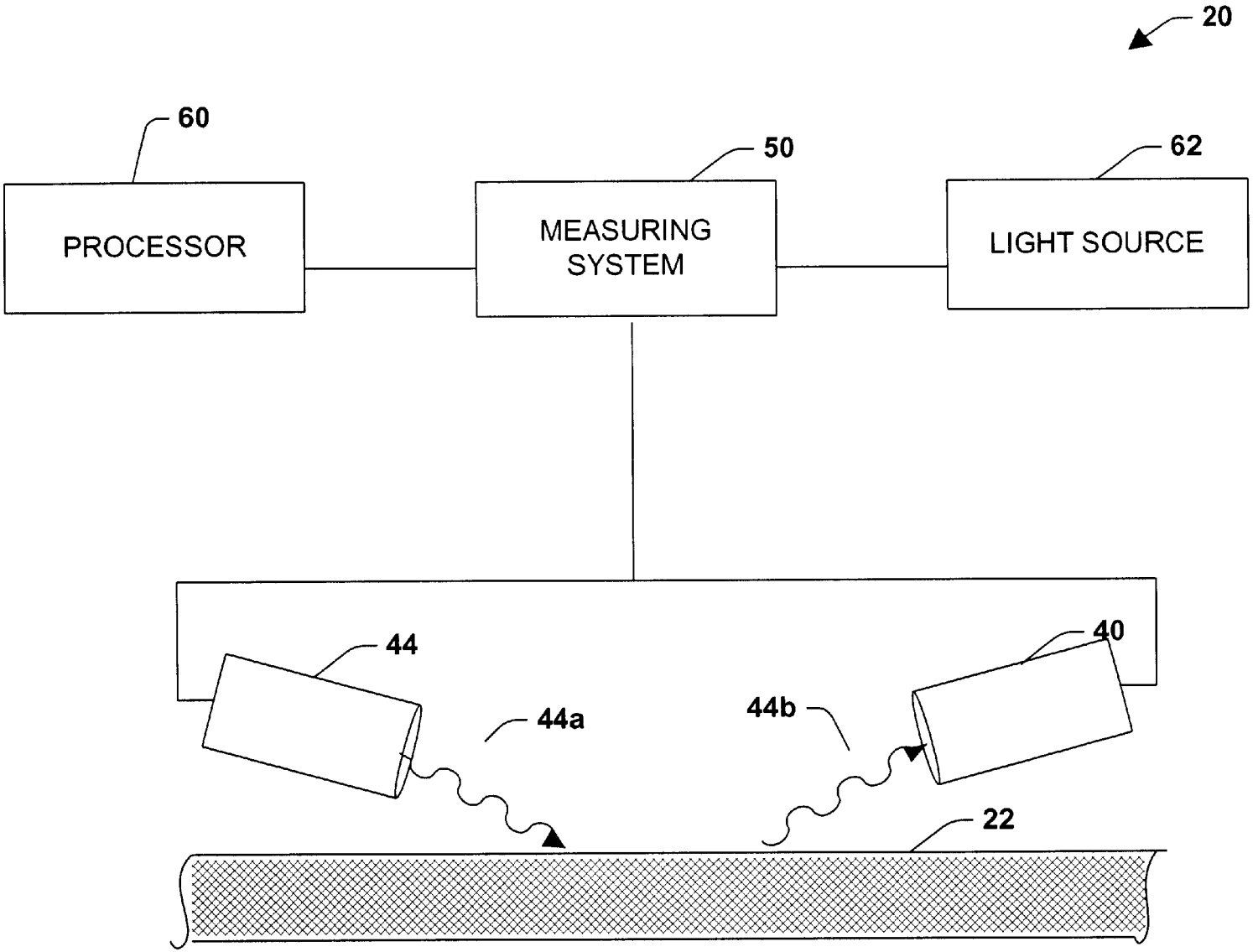
FIG. 5 is a partial schematic block diagram of the system of FIG. 4 being employed in connection with determining the progress of development by measuring grating size and/or shape in accordance with the present invention.

FIG. 5 illustrates the system 20 being employed to measure the progress of the development of a particular portion of the wafer 22. The temperature of the wafer 22 and/or the atmosphere near the wafer 22 will have an impact on the development of a pattern exposed on the wafer 22. The light source 44 directs a light 44*a* incident to the surface of the wafer 22. The reflected light 44*b* from the surface of the wafer 22 will vary (e.g., variations in phase and/or intensity) in accordance with the development of the pattern and/or gratings on the wafer 22. The one or more light detecting components 40 collect the reflected light 44*b*, pass the collected light and/or data concerning the collected light to the measuring system 50, which processes the reflected light 44*b* and/or data concerning the reflected light 44*b* in accordance with suitable techniques (e.g., scatterometry, spectroscopic ellipsometry) to provide the processor 60 with data corresponding to the progress of the development of the wafer 22.

Figure 6:
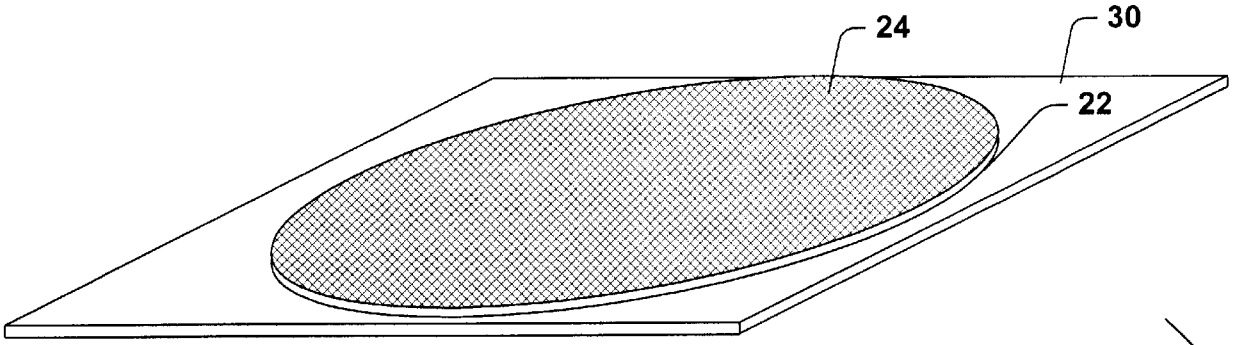
FIG. 6 is a perspective illustration of a substrate (including photo resist) having a pattern formed thereon in accordance with the present invention.
Figure 7:
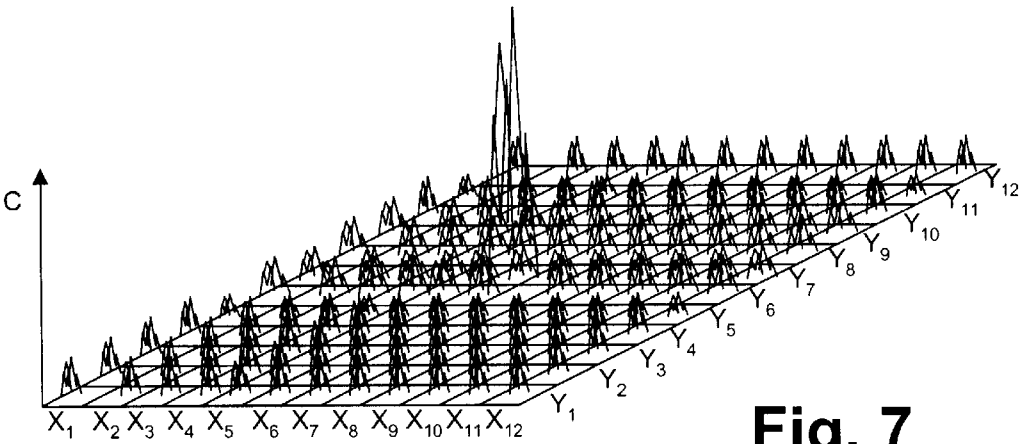
FIG. 7 is a representative three-dimensional grid map of a wafer illustrating development progress measurements taken at grid blocks of the grid map in accordance with the present invention.
Figure 8:
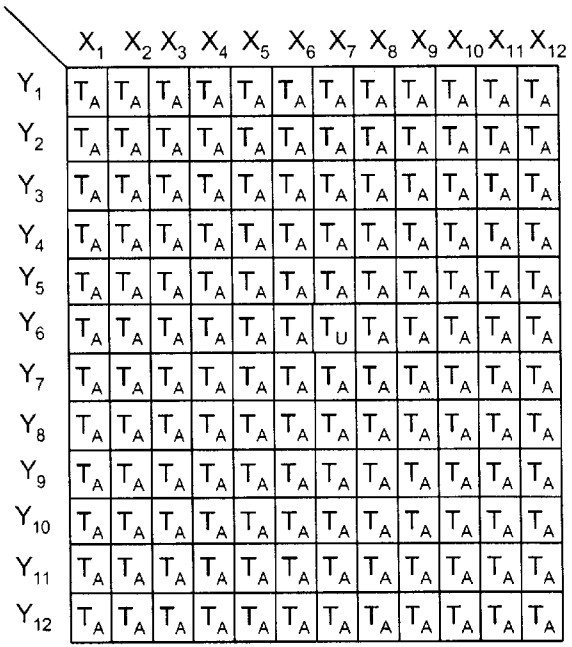
FIG. 8 is a development progress measurement table correlating the development progress measurements of FIG. 7 with desired values for the development progress measurements in accordance with the present invention.

Turning now to FIGS. 6–8 a chuck 30 is shown in perspective supporting a wafer 22 whereupon one or more gratings 24 and/or patterns may have been exposed and are being developed. The system 20 for controlling development temperature provides for regulating the time and/or temperature of the development process. The wafer 22 may be divided into a grid pattern as that shown in FIG. 7. Each grid block (XY) of the grid pattern corresponds to a particular portion of the wafer 22 and each grid block may have one or more gratings associated with that grid block. Each portion can be individually monitored for development and each portion may be individually controlled for temperature.

In FIG. 7, one or more gratings 24 in the respective portions of the wafer 22 ($X_1Y_1$ . . . $X_{12}$, $Y_{12}$) are being monitored for progress of development using reflective and/or passed through light, the measuring system 50 and the processor 60. The progress of development of each grating 24 is shown. As can be seen, the progress of development at coordinate $X_7Y_6$ is substantially higher than the progress of development of the other portions XY. It is to be appreciated that although FIG. 7 illustrates the wafer 22 being mapped (partitioned) into 144 grid block portions, the wafer 22 may be mapped with any suitable number of portions and any suitable number of gratings 24 may be employed. Although the present invention is described with respect to one heater 42 corresponding to one grid block XY, it is to be appreciated that any suitable number of heaters 42 corresponding to any suitable number of wafer 22 portions may be employed.

FIG. 8 is a representative table of progress of development measurements taken for the various grid blocks that have been correlated with acceptable progress of development values for the portions of the wafer 22 mapped by the respective grid blocks. As can be seen, all the grid blocks, except grid block $X_7Y_6$, have progress of development measurements corresponding to an acceptable development table value ($T_A$) (e.g., are within an expected range of progress of development measurements), while grid block $X_7Y_6$ has an undesired progress of development table value ($T_U$). Thus, the processor 60 has determined that an undesirable development condition exists at the portion of the wafer 22 mapped by grid block $X_7Y_6$. Accordingly, the processor 60 can drive one or more heaters (e.g., heater $\mathbf{42}_{7,6}$) which can affect the temperature of the portion of the wafer 22 mapped at grid block $X_7Y_6$, to bring the temperature of this portion of the wafer 22 to a level more likely to produce a desired development result. It is to be appreciated that the heaters 42 may be driven so as to maintain, increase and/or decrease the temperature of the respective wafer 22 portions as desired.

Figure 9:
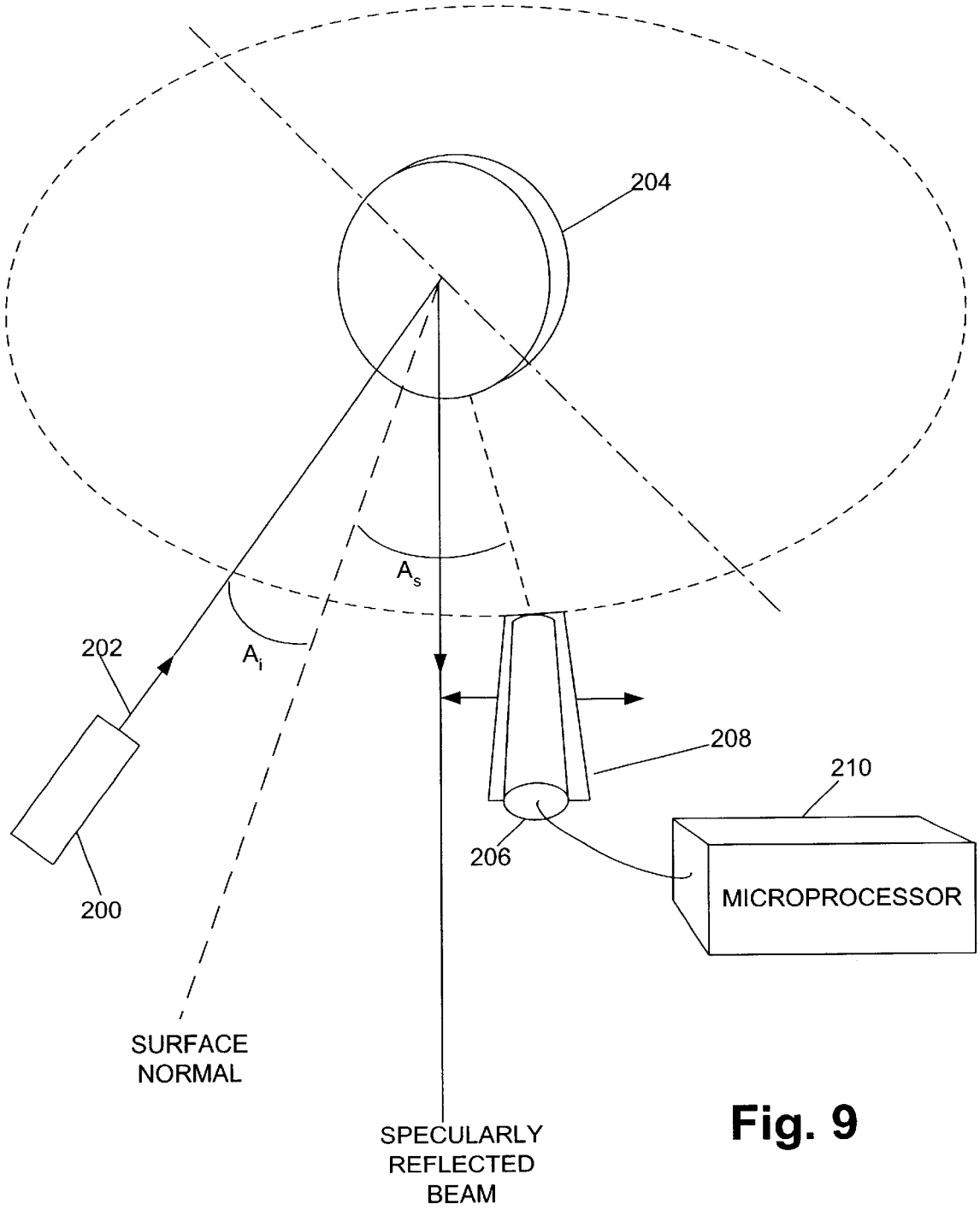
FIG. 9 illustrates an exemplary scatterometry system collecting reflected light.

FIG. 9 illustrates an exemplary scatterometry system collecting reflected light. Light from a laser 200 is brought to focus in any suitable well-known manner to form a beam 202. A sample, such as a wafer 204 is placed in the path of the beam 202 and a photo detector or photo multiplier 206 of any suitable well-known construction. Different detector methods may be employed to determine the scattered power. To obtain a grating pitch, the photo detector or photo multiplier 206 may be mounted on a rotation stage 208 of any suitable well-known design. A microprocessor 210, of any suitable well-known design, may be used to process detector readouts, including but not limited to angular locations of different diffracted orders leading to diffraction grating pitches being calculated. Thus, light reflected from the sample 204 may be accurately measured.

Figure 10:
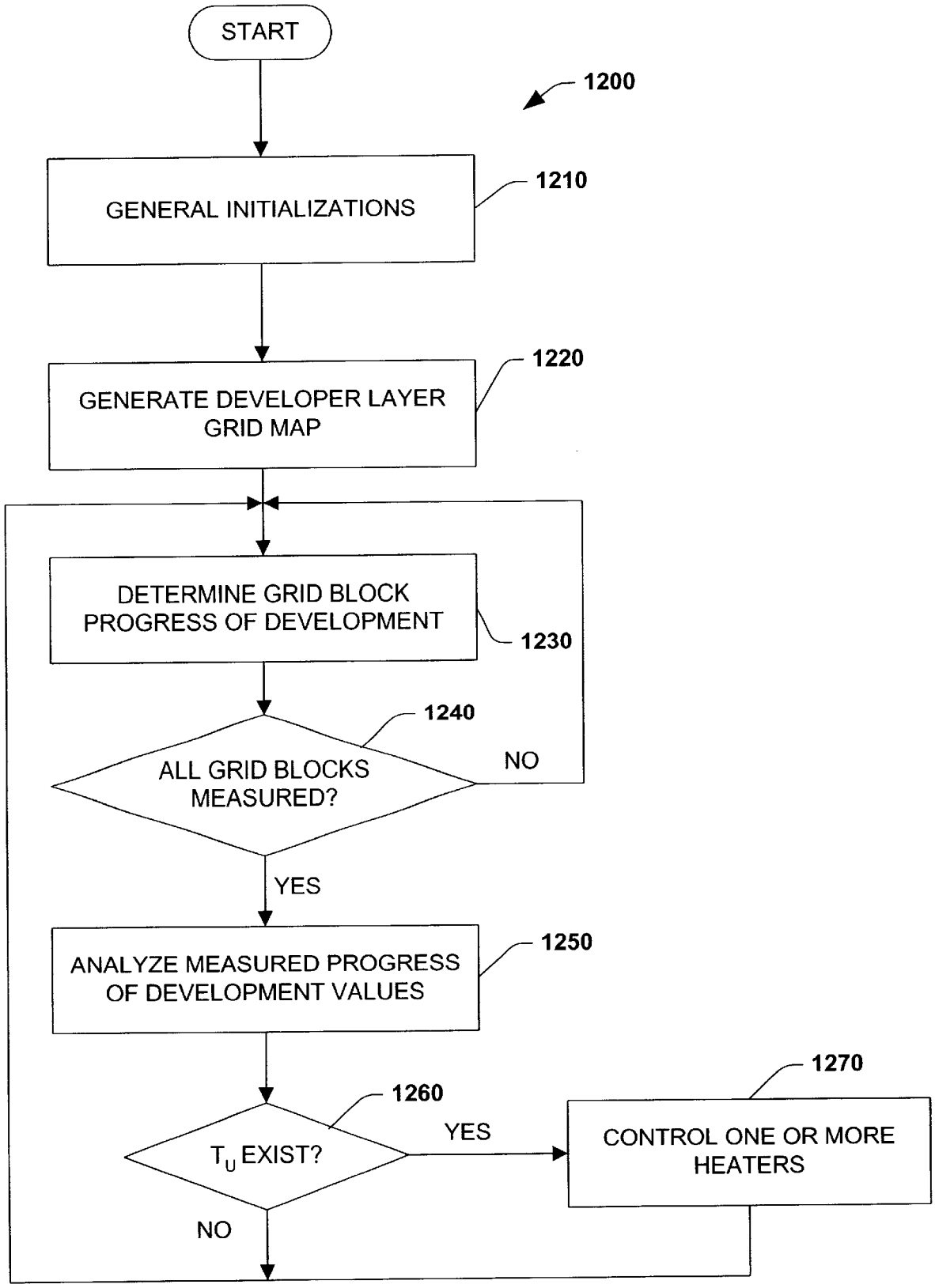
FIG. 10 is a flow diagram illustrating one specific methodology for carrying out the present invention.

In view of the exemplary systems shown and described above, a methodology, which may be implemented in accordance with the present invention, will be better appreciated with reference to the flow diagram of FIG. 10. While, for purposes of simplicity of explanation, the methodology is shown and described as a series of blocks, it is to be understood and appreciated that the present invention is not limited by the order of the blocks, as some blocks may, in accordance with the present invention, occur in different orders and/or concurrently with other blocks from that shown and described herein. Moreover, not all illustrated blocks may be required to implement a methodology in accordance with the present invention.

FIG. 10 is a flow diagram illustrating one particular methodology 1200 for carrying out the present invention. At 1210, general initializations are performed. Such initializations include, but are not limited to, allocating memory, establishing pointers, establishing data communications, acquiring resources, setting variables and displaying process activity. At 1220, at least a portion of a wafer is mapped into a plurality of grid blocks "XY". At 1230, progress of development determinations are made with respect to the various wafer portions mapped by the respective grid blocks XY. For example, reflected and/or passed through light can be analyzed to facilitate generating one or more signatures. At 1240, a determination is made concerning whether all grid block measurements have been taken. If the determination at 1240 is NO, then processing returns to block 1230. If the determination at block 1240 is YES, then at 1250 measured values are processed into development values that can be compared against acceptable progress of development values for the respective portions of the wafer. Such values may be stored in data structures including, but not limited to, databases, database tables, arrays, trees, linked lists, queues, stacks, heaps and data cubes, for example. At 1260, a determination is made concerning whether any progress of development values are not acceptable. If all progress of development values are acceptable, then processing returns to block 1230 for another iteration. If unacceptable progress of development values are found for any of the grid blocks, processing continues at 1270, where the unacceptable progress of development values are analyzed. After the analyses, feedback information is generated that can be employed to control one or more heaters operable to affect the temperature at grid blocks with unacceptable progress of development values. The present iteration is then ended and the process returns to 1230 to perform another iteration.

Scatterometry is a technique for extracting information about a surface upon which an incident light has been directed. Information concerning properties including, but not limited to, dishing, erosion, profile, chemical composition, thickness of thin films and critical dimensions of features present on a surface such as a wafer can be extracted. The information can be extracted by comparing the phase and/or intensity of the light directed onto the surface with phase and/or intensity signals of a complex reflected and/or diffracted light resulting from the incident light reflecting from and/or diffracting through the surface upon which the incident light was directed. The intensity and/or the phase of the reflected and/or diffracted light will change based on properties of the surface upon which the light is directed. Such properties include, but are not limited to, the chemical properties of the surface, the planarity of the surface, features on the surface, voids in the surface, and the number and/or type of layers beneath the surface.

Different combinations of the above-mentioned properties will have different effects on the phase and/or intensity of the incident light resulting in substantially unique intensity/phase signatures in the complex reflected and/or diffracted light. Thus, by examining a signal (signature) library of intensity/phase signatures, a determination can be made concerning the properties of the surface. Such substantially unique phase/intensity signatures are produced by light reflected from and/or refracted by different surfaces due, at least in part, to the complex index of refraction of the surface onto which the light is directed. The complex index of refraction (N) can be computed by examining the index of refraction (n) of the surface and an extinction coefficient (k). One such computation of the complex index of refraction can be described by the equation:

$$N=n-jk$$

where j is an imaginary number.

The signal (signature) library can be constructed from observed intensity/phase signatures and/or signatures generated by modeling and simulation. By way of illustration, when exposed to a first incident light of known intensity, wavelength and phase, a first feature on a wafer can generate a first phase/intensity signature. Similarly, when exposed to the first incident light of known intensity, wavelength and phase, a second feature on a wafer can generate a second phase/intensity signature. For example, a line of a first width may generate a first signature while a line of a second width may generate a second signature. Observed signatures can be combined with simulated and modeled signatures to form the signal (signature) library. Simulation and modeling can be employed to produce signatures against which measured phase/intensity signatures can be matched. In one exemplary aspect of the present invention, simulation, modeling and observed signatures are stored in a signal (signature) library containing over three hundred thousand phase/intensity signatures. Thus, when the phase/intensity signals are received from scatterometry detecting components, the phase/intensity signals can be pattern matched, for example, to the library of signals to determine whether the signals correspond to a stored signature.

Figure 11:
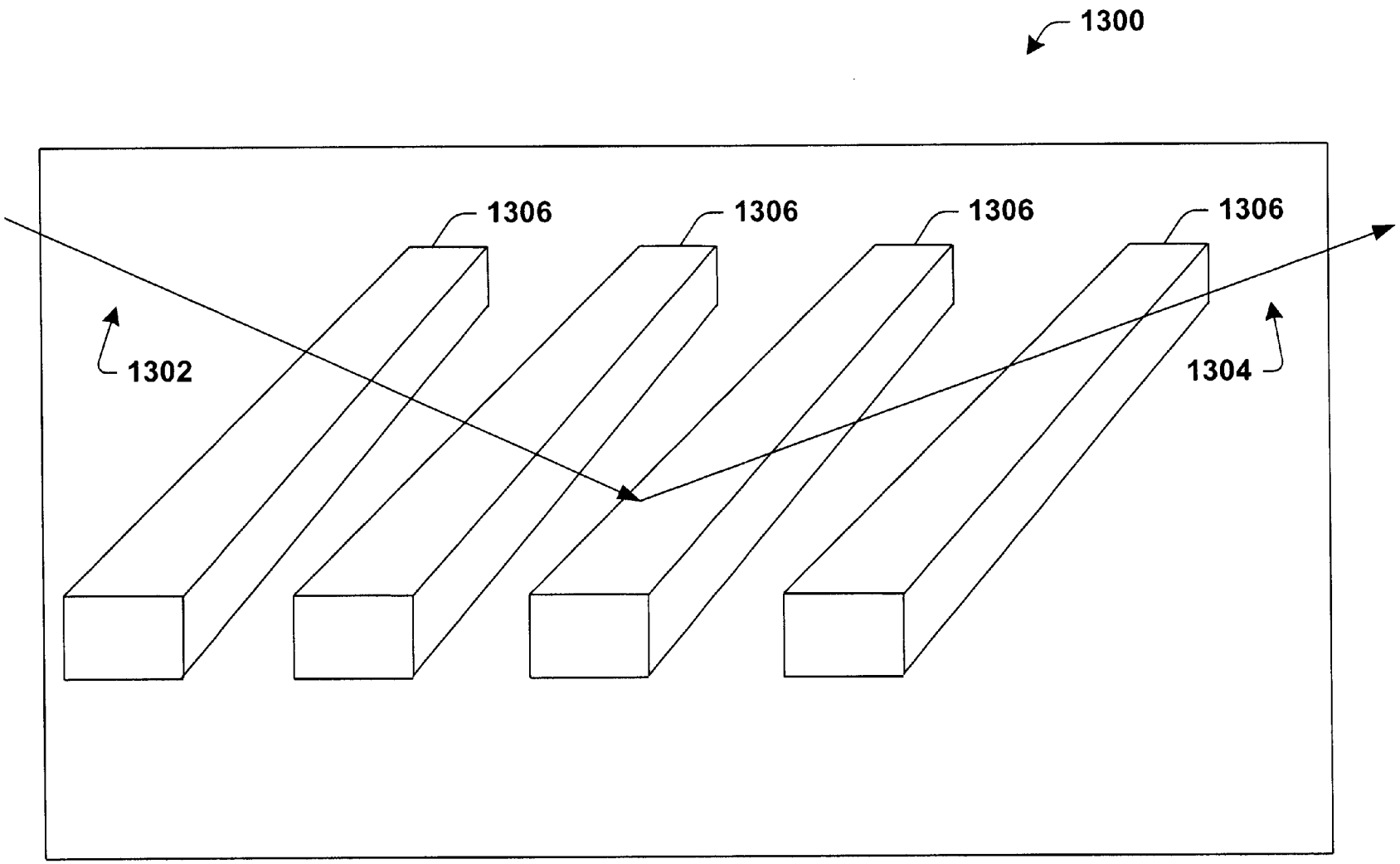
FIG. 11 is a simplified perspective view of an incident light reflecting off a surface, in accordance with an aspect of the present invention.
Figure 16:
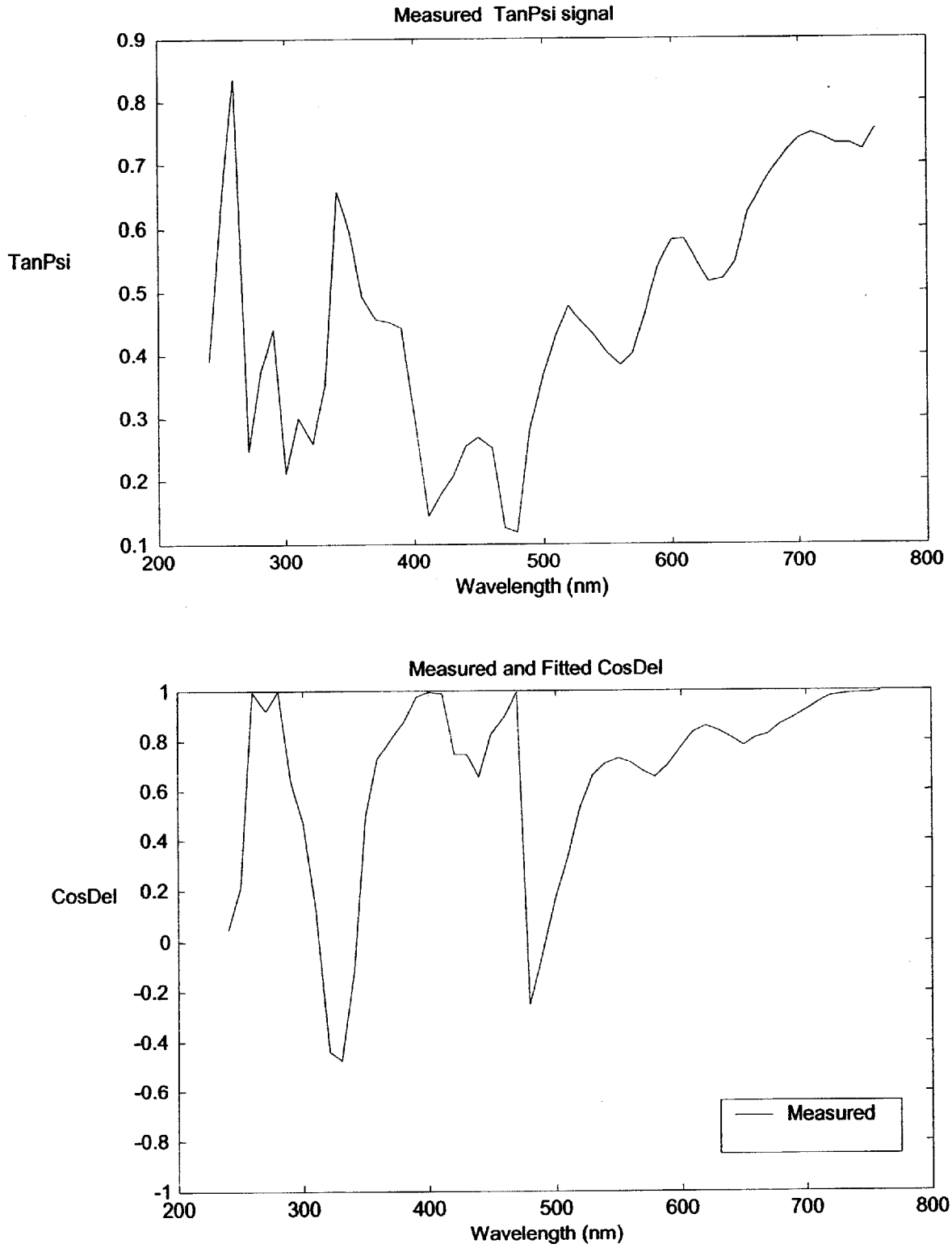
FIG. 16 illustrates phase and intensity signals recorded from a complex reflected and refracted light produced when an incident light is directed onto a surface, in accordance with an aspect of the present invention.

To illustrate the principles described above, reference is now made to FIGS. 11 through 16. Referring initially to FIG. 11, an incident light 1302 is directed at a surface 1300, upon which one or more features 1306 may exist. The incident light 1302 is reflected as reflected light 1304. The properties of the surface 1300, including but not limited to, thickness, uniformity, planarity, chemical composition and the presence of features, can affect the reflected light 1304. The features 1306 are raised upon the surface 1300. The phase and intensity of the reflected light 1304 can be measured and plotted, as shown, for example, in FIG. 16. The phase 1810 of the reflected light 1304 can be plotted, as can the intensity 1820 of the reflected light 1304. Such plots can be employed to compare measured signals with signatures stored in a signature library using techniques like pattern matching, for example.

Figure 12:
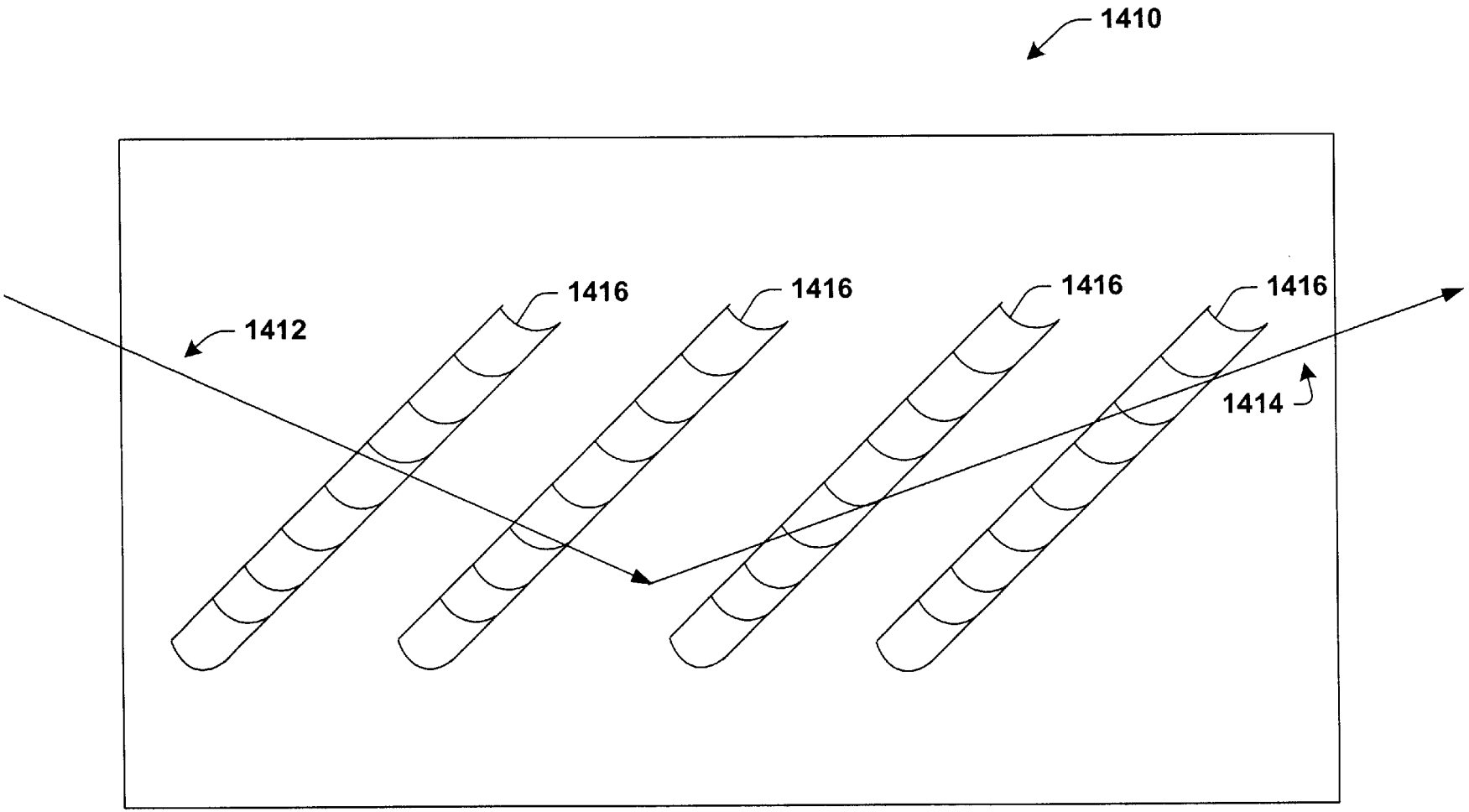
FIG. 12 is a simplified perspective view of an incident light reflecting off a surface, in accordance with an aspect of the present invention.

Referring now to FIG. 12, an incident light 1412 is directed onto a surface 1410 upon which one or more depressions 1416 appear. The incident light 1412 is reflected as reflected light 1414. Like the one or more features 1306 (FIG. 11) may affect an incident beam, so too may the one or more depressions 1416 affect an incident beam. Thus, it is to be appreciated that scatterometry can be employed to measure features appearing on a surface, features appearing in a surface, and properties of a surface itself, regardless of features.

Figure 13:
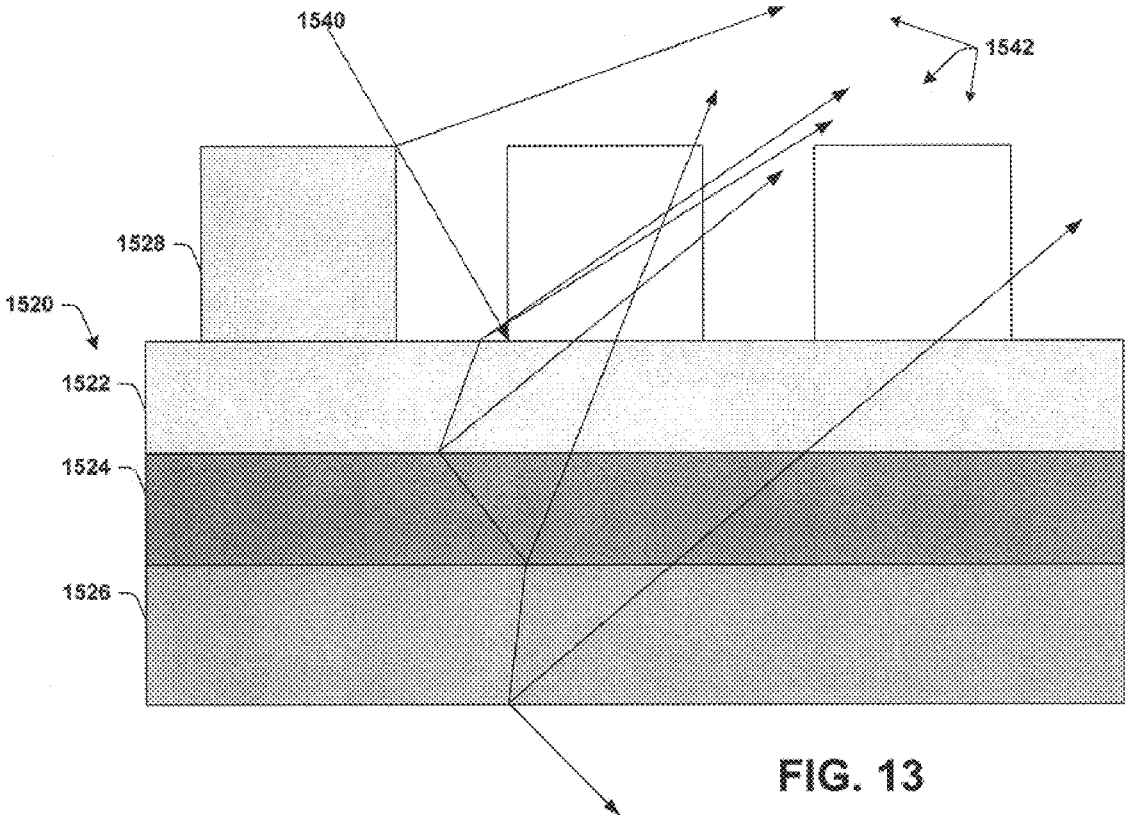
FIG. 13 illustrates a complex reflected and refracted light produced when an incident light is directed onto a surface, in accordance with an aspect of the present invention.

Turning now to FIG. 13, complex reflections and refractions of an incident light 1540 are illustrated. The reflection and refraction of the incident light 1540 can be affected by factors including, but not limited to, the presence of one or more features 1528, and the composition of the substrate 1520 upon which the features 1528 reside. For example, properties of the substrate 1520 including, but not limited to the thickness of a layer 1522, the chemical composition of the layer 1522, the opacity and/or reflectivity of the layer 1522, the thickness of a layer 1524, the chemical composition of the layer 1524, the opacity and/or reflectivity of the layer 1524, the thickness of a layer 1526, the chemical composition of the layer 1526, and the opacity and/or reflectivity of the layer 1526 can affect the reflection and/or refraction of the incident light 1540. Thus, a complex reflected and/or refracted light 1542 may result from the incident light 1540 interacting with the features 1528, and/or the layers 1522, 1524 and 1526. Although three layers 1522, 1524 and 1526 are illustrated, it is to be appreciated that a substrate can be formed of a greater or lesser number of such layers.

Figure 14:
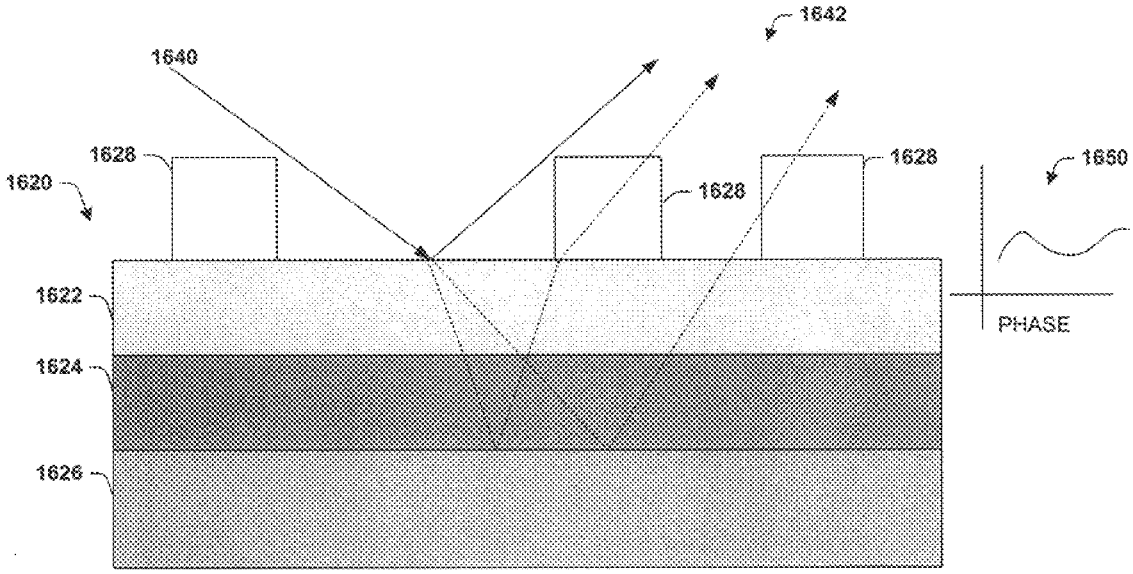
FIG. 14 illustrates a complex reflected and refracted light produced when an incident light is directed onto a surface, in accordance with an aspect of the present invention.
Figure 15:
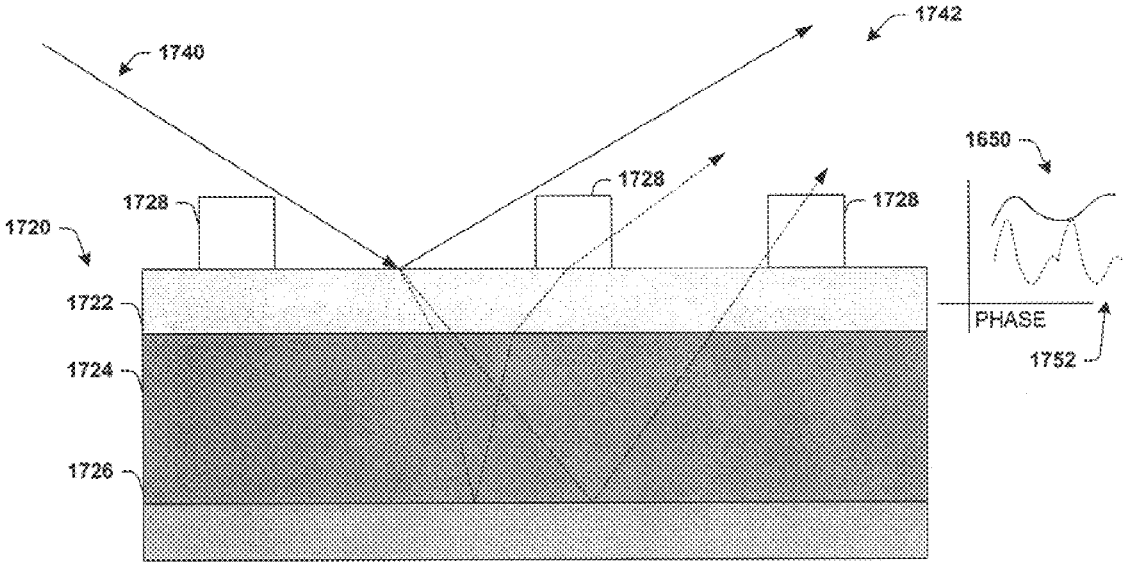
FIG. 15 illustrates a complex reflected and refracted light produced when an incident light is directed onto a surface, in accordance with an aspect of the present invention.

Turning now to FIG. 14, one of the properties from FIG. 13 is illustrated in greater detail. The substrate 1620 can be formed of one or more layers 1622, 1624 and 1626.

The phase 1650 of the reflected and/or refracted light 1642 can depend, at least in part, on the thickness of a layer, for example, the layer 1624. Thus, in FIG. 15, the phase 1752 of a reflected light 1742 differs from the phase 1650 due, at least in part, to the different thickness of the layer 1724 in FIG. 15 from the thickness of the layer 1624 in FIG. 14.

Thus, scatterometry is a technique that can be employed to extract information about a surface upon which an incident light has been directed. The information can be extracted by analyzing phase and/or intensity signals of a complex reflected and/or diffracted light. The intensity and/or the phase of the reflected and/or diffracted light will change based on properties of the surface upon which the light is directed, resulting in substantially unique signatures that can be analyzed to determine one or more properties of the surface upon which the incident light was directed.

The present invention provides for a system and method for regulating development time and temperature. As a result, the present invention facilitates improving development integrity and reliability, which in turn increases quality of image transfer in lithographic processes in accordance with the present invention.

Described above are examples of the present invention. It is, of course, not possible to describe every conceivable combination of parts, apparatus, components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A system for regulating development time and temperature, comprising:

at least one heater operative to heat at least one portion of a wafer;

a heater driving system for driving the at least one heater;

a system for directing light to the at least one portion of the wafer;

a measuring system for neasuring parameters of the progress of development based on light reflected from one or more gratings of the wafer; and a processor operatively coupled to the measuring system and the heater driving system, the processor receiving progress of development data from the measuring system and the processor using the data to at least partially base control of the at least one heater so as to regulate the development time and the temperature of the at least one portion of the developer.

2. The system of claim 1, wherein the heater is at least one of a heat lamp and a heating coil.

3. The system of claim 1, the measuring system further including a scatterometry system for processing the light reflected from the one or more gratings.

4. The system of claim 3, further comprising a measuring system for measuring parameters of the progress of development based on light passing through the one or more gratings.

5. The system of claim 4, the measuring system further including a scatterometry system for processing the light passing through the one or more gratings.

6. The system of claim 3, the processor being operatively coupled to the scatterometry system, the processor analyzing data relating to progress of development received from the scatterometry system, and the processor basing control of the at least one beater at least partially on the analyzed date.

7. The system of claim 5, the processor being operatively coupled to the scatterometry system, the processor analyzing data relating to progress of development received from the scatterometry system, and the processor basing control of the at least one heater at least partially on the analyzed data.

8. The system of claim 6, where the processor maps the wafer into a plurality of grid blocks and makes a determination of progress of development for the one or more grid blocks.

9. The system of claim 8, wherein the processor determines the existence of an unacceptable progress of development based upon the determined progress of development differing from an acceptable value.

10. The system of claim 9, wherein the processor controls the at least one heater to regulate the development time and/or the temperature of at least one wafer portion.

11. A method of regulating development time and temperature, comprising:

using at least one heater operative to heat at least one portion of a wafer;

using a heater driving system for driving the at least one heater;

employing a system for directing light to the at least one portion of the wafer;

employing a measuring system for measuring parameters of the progress of development based on light reflected from one or more gratings of the wafer; and employing a processor operatively coupled to the measuring system and the heater driving system, the processor receiving progress of development data from the measuring system and the processor using the data to at least partially base control of the at least one heater so as to regulate the development time and the temperature of the at least one portion of the developer.

12. The method of claim 11, further comprising using a scatterometry system to process the reflected light.

13. The method of claim 12, further comprising:

collecting light passing through the one or more gratings; and analyzing the passed through light to determine the progress of development of the one or more portions.

14. The method of claim 13, further comprising using a scatterometry system to process the passed through light.

15. The method of claim 12, further comprising employing a processor to control the at least one heater based at least partially on data received from the scatterometry system.

16. The method of claim 14, further comprising employing a processor to control the at least one heater based at least partially on data received from the scatterometry system.

* * * * *

UNITED STATES PATENT AND TRADEMARK OFFICE

CERTIFICATE OF CORRECTION

PATENT NO. : 6,629,786 B1 
DATED : October 7, 2003
INVENTOR(S) : Bharath Rangarajan et al.

It is certified that error appears in the above-identified patent and that said Letters Patent is hereby corrected as shown below:

Column 12,
Line 33, “neasuring” should be -- measuring --.
Line 58, “beater” should be -- heater --; and “date” should be -- data --.

Signed and Sealed this

Twenty-fourth Day of February, 2004

JON W. DUDAS
*Acting Director of the United States Patent and Trademark Office*